US007066587B2

(12) United States Patent
Andersen et al.

(10) Patent No.: US 7,066,587 B2
(45) Date of Patent: Jun. 27, 2006

(54) PARTITION STRUCTURES FOR THE INTERIOR OF AN INK CONTAINER

(75) Inventors: Stephen A. Andersen, Williamson, TN (US); Dennis M. Lengyel, Ontario, NY (US)

(73) Assignee: Nu-Kote International, Inc., Franklin, TN (US)

( * ) Notice: Subject to any disclaimer, the term of this patent is extended or adjusted under 35 U.S.C. 154(b) by 229 days.

(21) Appl. No.: 10/754,989

(22) Filed: Jan. 12, 2004

(65) Prior Publication Data

US 2005/0151806 A1 Jul. 14, 2005

(51) Int. Cl.
*B41J 2/175* (2006.01)

(52) U.S. Cl. ..... 347/86; 347/87
(58) Field of Classification Search ..... 347/85, 347/86, 87
See application file for complete search history.

(56) References Cited

U.S. PATENT DOCUMENTS

| | | | | |
|---|---|---|---|---|
| 4,513,297 | A * | 4/1985 | Okamura | 347/85 |
| 6,095,643 | A * | 8/2000 | Cook et al. | 347/87 |
| 6,113,230 | A * | 9/2000 | Ishinaga et al. | 347/86 |
| 6,331,054 | B1 * | 12/2001 | Seu et al. | 347/87 |
| 6,557,988 | B1 * | 5/2003 | Hartman | 347/85 |
| 6,840,609 | B1 * | 1/2005 | Lo et al. | 347/86 |
| 6,851,800 | B1 * | 2/2005 | Seu | 347/86 |

* cited by examiner

*Primary Examiner*—Anh T. N. Vo
(74) *Attorney, Agent, or Firm*—Fay, Sharpe, Fagan, Minnich & McKee, LLP

(57) ABSTRACT

An ink container shell for an ink jet cartridge has spaced apart side walls, a front wall, a rear wall, and a bottom wall, and is provided with a partition structure which divides the interior thereof into three ink chambers, at least one of which has a non-rectangular profile in cross-section transverse to said side, front and rear walls. The partition structures enable varying the volumes of the ink chambers with respect to a given shell exterior profile and enable isolating two the chambers from one another by interposing the third chamber therebetween.

36 Claims, 3 Drawing Sheets

PARTITION STRUCTURES FOR THE INTERIOR OF AN INK CONTAINER

BACKGROUND OF THE INVENTION

This invention relates to the art of ink jet printers and, more particularly, to improvements in the configurations of ink chambers and partitions in the interior of the casing or shell of an ink container for an inkjet cartridge for color printing.

As is known, an inkjet cartridge includes an ink container comprising a shell defined by spaced apart side walls, a front wall, a rear wall, and a bottom wall and, for color printing, the interior of the container is partitioned to define a plurality of chambers, each for a different color ink. Each of the chambers has an outlet port in the bottom wall for communication with a corresponding ink tapping component in a casing receiving the container, and the upper end of the container is closed by a cover which is heat sealed in place following the filling of the chambers with ink.

Heretofore, the partition has been T-shaped in cross-section transverse to the side, front and rear walls whereby, for a given outer profile for the shell, the volume of each of the three chambers is substantially fixed. In this respect, the ability to change the dimensions of the leg or cross piece of the T so as to change the volumes in the three chambers is extremely limited. Moreover, with a T-shaped partition, each of the chambers is directly adjacent the other two, whereby a leakage problem across the leg or cross piece can result in the mixing of the ink in one chamber with the ink in both of the other two chambers.

SUMMARY OF THE INVENTION

In accordance with the present invention, the interior of the shell of an ink container is provided with partition designs which, in accordance with one aspect of the invention, provide the ability to selectively design the chambers to have equal or different volumes. In accordance with another aspect of the invention, partition designs advantageously provide for each of the chambers to be immediately adjacent just one of the other two chambers. Accordingly, a leakage problem across a partition wall between adjacent chambers can only result in the mixing of the ink in the one chamber with that in the adjacent chamber.

It is accordingly an outstanding object of the present invention to provide improved partition designs for the interior of an ink container shell of an ink container for an ink jet cartridge.

Another object is the provision of an ink container shell of the foregoing character having improved versatility with respect to selectively designing the volumes of the ink chambers.

Yet another object is the provision of a container shell of the foregoing character which advantageously optimizes isolation of the chambers from one another to minimize color mixing in the event of leakage between chambers.

BRIEF DESCRIPTION OF THE DRAWINGS

The foregoing objects, and others, will in part be obvious and in part pointed out more fully hereinafter in conjunction with the written description of preferred embodiments of the invention illustrated in the accompanying drawings in which.

DESCRIPTION OF PREFERRED EMBODIMENTS

Figure 2:
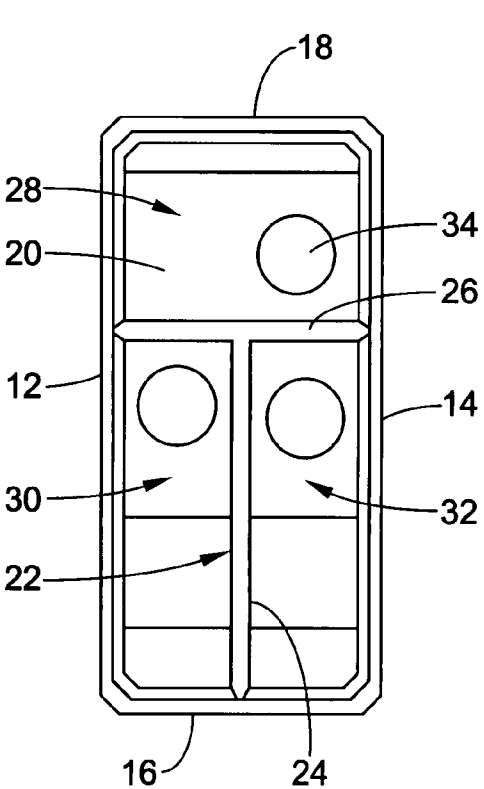
FIG. 2 is a top view of the shell showing a T-shaped partition therein.
Figure 1:
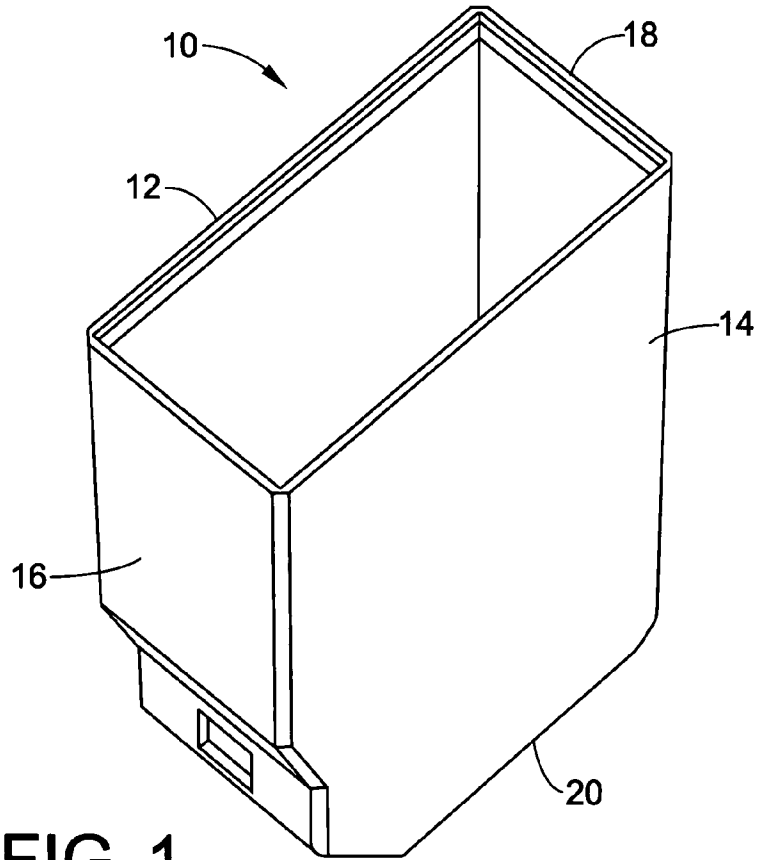
FIG. 1 is a perspective view of an ink container shell for an inkjet cartridge.

Referring now in detail to the drawings, wherein the showings are for the purpose of illustrating preferred embodiments of the invention only, and not for the purpose of limiting the invention, an ink container shell 10 is shown in FIGS. 1 and 2 of the drawing which is comprised of a pair of spaced apart side walls 12 and 14, a front wall 16, a rear wall 18 and a bottom wall 20. As shown in FIG. 2, it is well known to provide the interior of the shell with a T-shaped partition 22 defined by a leg 24 and a cross piece 26 which divide the interior of the shell into three ink chambers 28, 30 and 32. The T-shaped profile of partition 22 provides for each of the chambers 28, 30 and 32 to be rectangular in cross-section transverse to the side, front and rear walls of shell ten. Further, it will be appreciated from FIG. 2 that chamber 28 is directly adjacent both chambers 30 and 32 and that each of the chambers 30 and 32 is directly adjacent one another as well as chamber 28. Accordingly, leakage across cross piece 26, for example, can result in the mixing of all three ink colors in one chamber. An outlet port 34 is provided in bottom wall 20 for each of the chambers and, as will be appreciated from FIG. 2, the T-shaped profile of the partition limits the ability to vary the cross-sectional areas of the chambers, and thus the volumes thereof, from that shown in FIG. 2.

Embodiments of the present invention are shown in FIGS. 3–7 of the drawing in conjunction with a container shell 10 which is basically of the structure shown in FIG. 1, whereby the component parts thereof are indicated by the same numerals in FIGS. 3–7 as appear in FIG. 1. Moreover, while the chambers in the embodiments shown in FIGS. 3–7 have different contours from the chambers shown in FIG. 2, the chambers are numbered the same as in the latter figure for purposes of comparison in size and shape.

Figure 4:
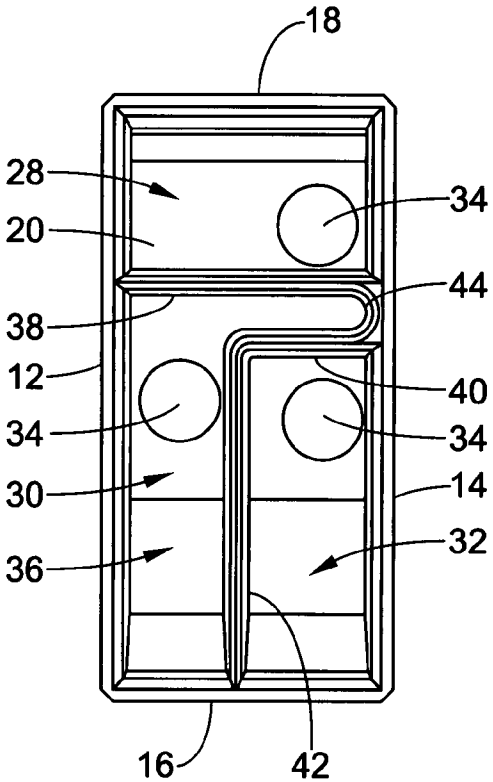
FIG. 4 is a top view of the shell and partition shown in FIG. 3.
Figure 3:
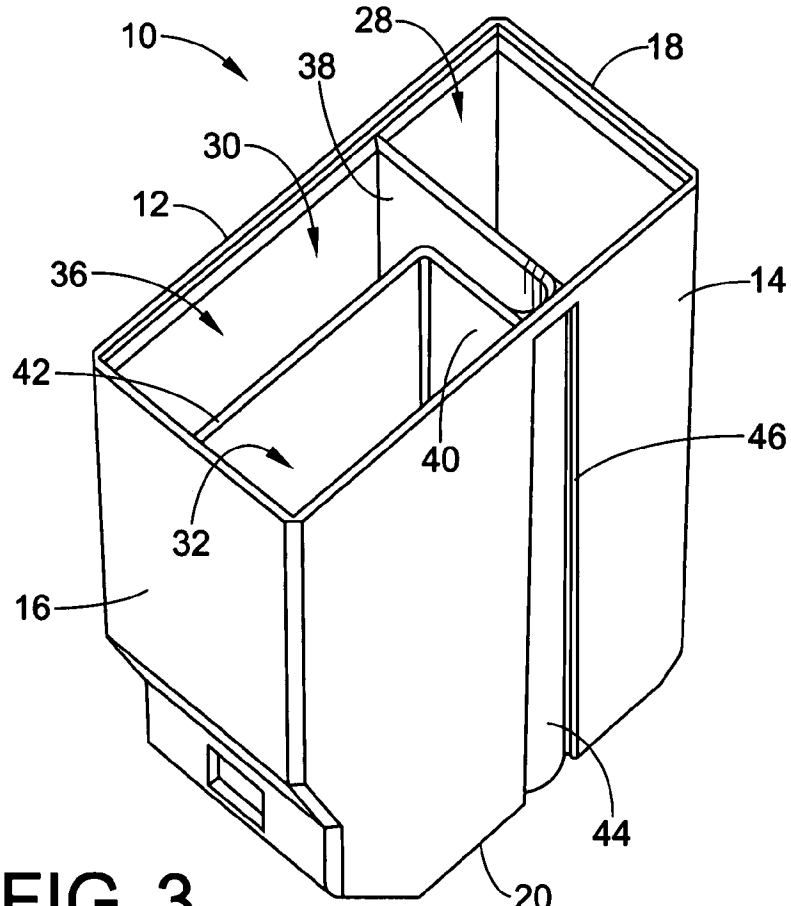
FIG. 3 is a perspective view of the container shell shown in FIG. 1 and illustrates an L-shaped partition design inside the shell.

With reference first to the embodiment shown in FIGS. 3 and 4 of the drawing, the interior of shell 10 is provided with a partition 36 defined by a first wall 38 extending between side walls 12 and 14, a second wall 40 spaced from wall 38 and extending from side wall 14 toward side wall 12, and a third wall 42 between side walls 12 and 14 and extending from the inner end of wall 40 to rear wall 16. Partition 36 further includes an arcuate bridging wall 44 connecting walls 38 and 40 at side wall 14 of the shell. In the embodiment shown in FIGS. 3 and 4, partition 36 is of one-piece construction, and side wall 14 of shell 10 is provided with a vertical slot 46 which receives bridging wall 44 and to which the latter is heat welded to seal the corresponding portions of chambers 28 and 32. It will be appreciated, however, as will become apparent with the embodiments described hereinafter, that walls 38 and 40 of the partition could be separate from one another and sealingly interengaged with wall 14 through a tongue and groove arrangement. The one-piece construction shown in FIGS. 3 and 4 is advantageous from the standpoint of minimizing the component parts necessary to produce an ink container.

As will be further appreciated from FIGS. 3 and 4 of the drawing, the profile of partition 36 provides for ink chamber 30 to have an L-shaped configuration in cross-section and for ink chambers 28 and 32 to be generally of rectangular configuration as are all three of the chambers in FIG. 2. The L-shaped configuration of chamber 30 advantageously enables the latter to have a larger volume than chamber 30 in FIG. 2, and the profile of partition 36 can be modified to enable varying the volumes of the three chambers. In particular in this respect, it will be appreciated that leg 42 of the partition can be shifted to the right in FIG. 4 to vary the volumes of chambers 30 and 32.

As will be further appreciated from FIG. 4, chambers 28 and 32 are isolated from one another by chamber 30. Therefore, leakage across any one of the partition walls 38, 40 and 42 can only result in the mixing of one color with one of the other two colors.

Figure 5:
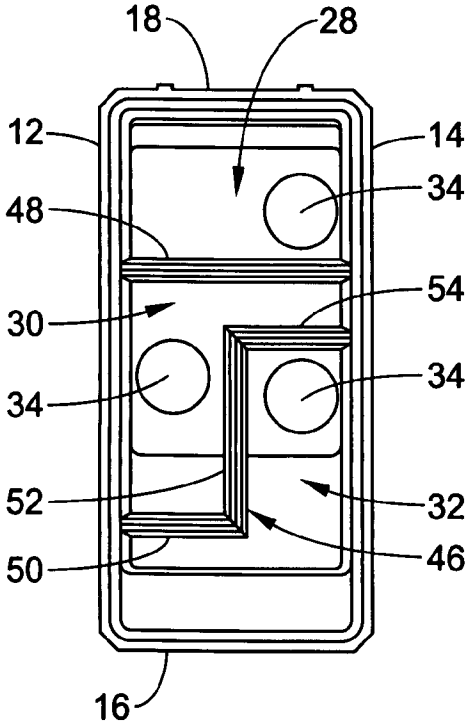
FIG. 5 is a top view of another embodiment of the partitioned interior of a container shell in accordance with the invention.

In FIG. 5, the partition structure includes a first partition wall 46 which is S-shaped and a second partition wall 48 spaced therefrom. S-shaped wall 46 includes a first leg 50 extending inwardly from side wall 12 of the casing and transverse thereto, a second leg 52 extending from the inner end of leg 50 in the direction between front and rear walls 16 and 18 of the casing, and a third leg 54 extending from the second leg to side wall 14 of the casing and transverse thereto. Second partition wall 48 extends between side walls 12 and 14 and perpendicular thereto, whereby legs 50 and 54 of partition wall 46 lie in planes which are parallel to one another and to the plane of partition wall 48. This partition profile provides for chambers 30 and 32 to be non-rectangular and for chambers 28 and 32 to be isolated from one another by chamber 30. It will be appreciated that the positions of leg 54 and/or partition wall 48 can be selectively modified, as can the length of leg 52 of partition wall 46, to achieve a desired volume for each of the chambers. Moreover, as will be appreciated from FIGS. 3 and 4, the ends of leg 54 and partition wall 48 could be connected by a U-shaped bridging portion connected to wall 14 as described in connection with FIGS. 3 and 4. Likewise, as will be appreciated from FIG. 5, legs 38 and 40 of the partition shown in FIGS. 3 and 4 could interengage with wall 14 of the shell in the tongue and groove relationship shown in FIG. 5.

Figure 6:
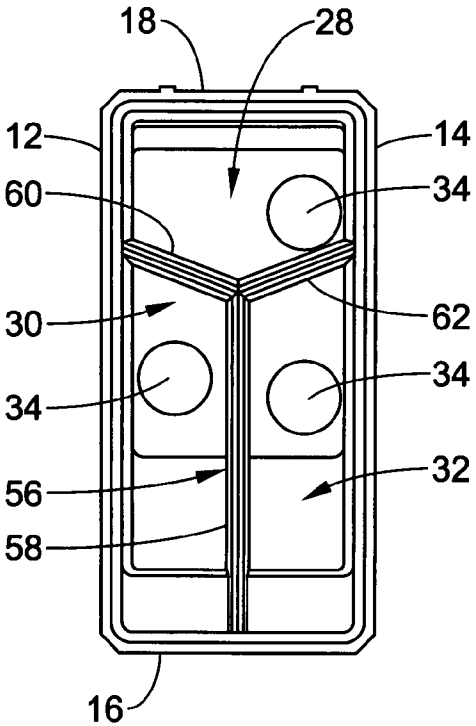
FIG. 6 is a top view of yet another embodiment of the partitioned interior of a container shell according to the invention; and, FIG. 7 is a further embodiment of the partitioned interior of a container shell according to the invention.

In the embodiment shown in FIG. 6 of the drawing, chambers 28, 30 and 32 are defined by a Y-shape partition 56 having a first leg 58 extending from front wall 16 toward rear wall 18 generally centrally between and parallel to side walls 12 and 14, and second and third legs 60 and 62 which extend respectively from leg 58 to side wall 12 and side wall 14 at an angle to leg 58 and the corresponding side wall. It will be appreciated that the length of leg 58 as well as the angles of legs 60 and 62 relative thereto and to the side walls can be varied so as to obtain a desired volume for each of the chambers. In this embodiment, each of the three chambers is non-rectangular in cross-section transverse to the side, front and rear walls of the casing.

Figure 7:
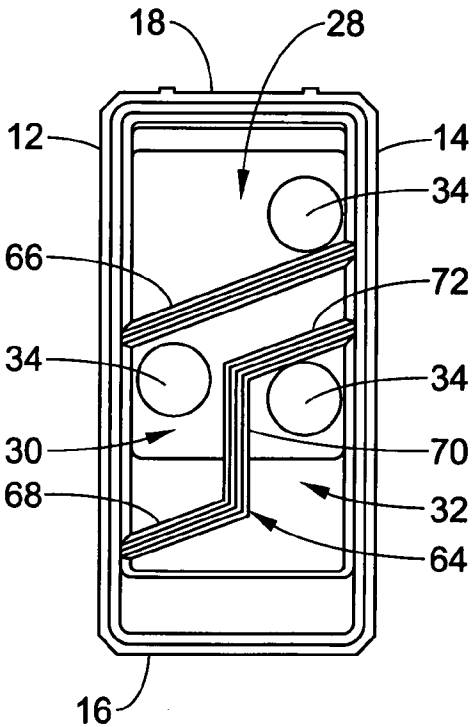

In the embodiment shown in FIG. 7, the partition structure is defined by a Z-shaped wall 64 and a second wall 66 spaced therefrom. Z-shaped wall 64 includes a first leg 68 extending from side wall 12 toward side wall 14 and at an incline relative to wall 12, a second leg 70 extending from the inner end of leg 68 toward rear wall 18, and a third leg 72 extending from leg 70 to side wall 14 of the shell and at an incline thereto. Wall 66 extends between side walls 12 and 14 and is inclined relative thereto and, preferably, legs 68 and 72 and wall 66 lie in parallel planes. The partition structure in FIG. 7 provides for each of the chambers 28, 30 and 32 to be non-rectangular in cross-section transverse to the side, front and rear walls of the shell and further provides for chambers 28 and 32 to be isolated from one another by chamber 30 therebetween. As will be appreciated from FIG. 7, the length of leg 70 and/or the angles of incline of legs 68 and 72 and wall 66 and/or the spacing between wall 66 and leg 72 can be altered to obtain a desired volume for each of the chambers.

While considerable emphasis has been placed on preferred embodiments herein illustrated and described, it will be appreciated that other embodiments can be devised and that changes can be made in the embodiments disclosed herein without departing from the principals of the invention. In this respect, for example, many partition profiles can be devised which will provide for selectively varying the volumes of the three chambers and which will provide for two of the chambers to be isolated from one another by the third chamber. These and other embodiments and modifications will be obvious from the disclosure herein. Accordingly, it is to be distinctly understood that it is intended to include all such modifications as well as other embodiments insofar as they come within the scope of the appended claims or the equivalents thereof.

The invention claimed is:

1. An ink container shell for an ink jet cartridge comprising spaced apart side walls, a front wall, a rear wall and a bottom wall, and at least one partition in said container dividing the interior thereof into three ink chambers, an outlet port in said bottom wall for each chamber, and at least one of said chambers having a non-rectangular profile in cross-section transverse to said side, front and rear walls.

2. An ink container shell according to claim 1, wherein at least two of said chambers have non-rectangular profiles in cross-section.

3. An ink container shell according to claim 2, wherein said at least two chambers are L-shaped in cross-section.

4. An ink container shell according to claim 1, wherein each of the three chambers has a non-rectangular profile in cross-section.

5. An ink container shell according to claim 4, wherein two of the three chambers have the same profile in cross-section.

6. An ink container shell according to claim 4, wherein each of the three chambers has a profile in cross-section different from the other two.

7. An ink container shell according to claim 1, wherein said at least one chamber is L-shaped in cross-section.

8. An ink container shell according to claim 1, wherein said at least one partition includes a Z-shaped wall extending between said side walls.

9. An ink container shell according to claim 1, wherein said at least one partition includes an S-shaped wall extending between said side walls.

10. An ink container shell according to claim 1, wherein said at least one partition is Y-shaped.

11. An ink container shell according to claim 10, wherein said Y-shaped partition includes a first leg extending inwardly from one of said front, rear and side walls, and second and third legs extending from said first leg and at an angle thereto and to one another.

12. An ink container shell according to claim 11, wherein said first leg extends from one of said front and rear walls toward the other.

13. An ink container shell according to claim 12, wherein said second and third legs extend respectively to one and the other of said side walls.

14. An ink container shell according to claim 13, wherein each said second and third leg extends from said first leg of the same angle thereto.

15. An ink container shell for an ink jet cartridge comprising spaced apart side walls, a front wall, a rear wall and a bottom wall, and at least one partition in said container dividing the interior thereof into three ink chambers, an outlet port in said bottom wall for each chamber, and at least one of said chambers having a non-rectangular profile in cross-section transverse to said side, front and rear walls, said at least one partition including a first wall extending from one of said side walls to the other, a second wall spaced from said first wall and extending from said other side wall toward said one side wall, and a third wall between said side walls and extending from said second wall to one of said front and rear walls.

16. An ink container shell according to claim 15, and an arcuate bridging wall between said first and second walls at said other side wall.

17. An ink container shell according to claim 15, wherein said first, second and third walls define an L-shaped chamber with said one of said side walls and said one of said front and rear walls.

18. An ink container shell according to claim 15, wherein said other side has a slot therein and said bridging wall extends into said slot.

19. An ink container shell according to claim 18 wherein said bridging wall is sealed in said slot.

20. An ink container shell for an ink jet cartridge comprising spaced apart side walls, a front wall, a rear wall and a bottom wall, and at least one partition in said container dividing the interior thereof into three ink chambers, an outlet port in said bottom wall for each chamber, and at least one of said chambers having a non-rectangular profile in cross-section transverse to said side, front and rear walls, said at least one partition including a Z-shaped wall extending between said side walls, and said at least one partition including a second wall spaced from said Z-shaped wall.

21. An ink container shell according to claim 20, wherein said second wall extends between said side walls.

22. An ink container shell according to claim 21, wherein said second wall is planar and at an incline to said side walls.

23. An ink container shell for an ink jet cartridge comprising spaced apart side walls, a front wall, a rear wall and a bottom wall, and at least one partition in said container dividing the interior thereof into three ink chambers, an outlet port in said bottom wall for each chamber, and at least one of said chambers having a non-rectangular profile in cross-section transverse to said side, front and rear walls, said at least one partition including a Z-shaped wall extending between said side walls, and said Z-shaped wall including a first leg extending from one of said side walls at an incline thereto and toward the other side wall, a second leg extending from said first leg in the direction between said front and rear walls, and a third leg extending from said second leg to said other side wall and at an incline thereto.

24. An ink container shell according to claim 23, wherein said first and third legs are in parallel planes.

25. An ink container shell according to claim 24, wherein said at least one partition includes a second wall spaced from said Z-shaped wall and extending between said side walls.

26. An ink container shell according to claim 25, wherein said second wall is in a plane parallel to said parallel planes.

27. An ink container shell for an ink jet cartridge comprising spaced apart side walls, a front wall, a rear wall and a bottom wall, and at least one partition in said container dividing the interior thereof into three ink chambers, an outlet port in said bottom wall for each chamber, and at least one of said chambers having a non-rectangular profile in cross-section transverse to said side, front and rear walls, said at least one partition including an S-shaped wall extending between said side walls, and said at least one partition including a second wall spaced from said S-shaped wall.

28. An ink container shell according to claim 27, wherein said second wall extends between said side walls.

29. An ink container shell according to claim 28, wherein said second wall is planar and perpendicular to said side walls.

30. An ink container shell for an ink jet cartridge comprising spaced apart side walls, a front wall, a rear wall and a bottom wall, and at least one partition in said container dividing the interior thereof into three ink chambers, an outlet port in said bottom wall for each chamber, and at least one of said chambers having a non-rectangular profile in cross-section transverse to said side, front and rear walls, said at least one partition including an S-shaped wall extending between said side walls, and said S-shaped wall including a first leg extending from one of said side walls transverse thereto and toward the other side wall, a second leg extending from said first leg in the direction between said front and rear walls, and a third leg extending from said second leg to said other side wall and transverse thereto.

31. An ink container shell according to claim 30, wherein said first and third legs are in parallel planes.

32. An ink container shell according to claim 31, wherein said at least one partition includes a second wall spaced from said S-shaped wall and extending between said side walls.

33. An ink container shell according to claim 32, wherein said second wall is in a plane parallel to said parallel planes.

34. An ink container shell for an ink jet cartridge comprising spaced apart side walls, a front wall, a rear wall and a bottom wall, and at least one partition in said container dividing the interior thereof into three ink chambers, an outlet port in said bottom wall for each chamber, and said at least one partition providing for one chamber to be between the other two chambers.

35. An ink container shell for an ink jet cartridge comprising spaced apart side walls, a front wall, a rear wall and a bottom wall, and at least one partition in said container dividing the interior thereof into three ink chambers, an outlet port in said bottom wall for each chamber, and said at least one partition providing for two of the chambers to be isolated from one another by the third chamber.

36. An ink container shell for an ink jet cartridge comprising spaced apart side walls, a front wall, a rear wall and a bottom wall, and at least one partition in said container dividing the interior thereof into three ink chambers, an outlet port in said bottom wall for each chamber, and said at least one partition providing for one of the chambers to be immediately adjacent just one of the other two chambers.

* * * * *